US008083161B2

(12) United States Patent
Lind et al.

(10) Patent No.: US 8,083,161 B2
(45) **Date of Patent: *Dec. 27, 2011**

(54) HANDHELD SPRAYER WITH REMOVABLE CARTRIDGE AND METHOD OF USING SAME

(75) Inventors: James J. Lind, Westerville, OH (US); Gregory Trees, Columbus, OH (US); Joseph E. Zambanini, Delaware, OH (US); Brian Graham, Dublin, OH (US); R. Reade Harpham, Columbus, OH (US)

(73) Assignee: Battelle Memorial Institute, Columbus, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/689,299

(22) Filed: Jan. 19, 2010

(65) Prior Publication Data

US 2010/0116897 A1 May 13, 2010

Related U.S. Application Data

(62) Division of application No. 11/474,744, filed on Jun. 26, 2006, now Pat. No. 7,673,819.

(51) Int. Cl.
*B05B 5/00* (2006.01)

(52) U.S. Cl. ..... 239/690; 239/690.1; 239/692; 239/704; 239/708; 239/548; 222/390

(58) Field of Classification Search ..... 239/690, 239/690.1, 692, 704, 708; 222/390
See application file for complete search history.

(56) References Cited

U.S. PATENT DOCUMENTS

| | | | |
|---|---|---|---|
| 1,221,578 | A | 4/1917 | O'Connell |
| 1,614,461 | A | 1/1927 | Doi |
| 1,751,139 | A | 3/1930 | Feinstein |
| 1,818,464 | A | 8/1931 | Davis |
| 2,943,602 | A | 7/1960 | Rundle |
| 3,101,711 | A | 8/1963 | Reitknect |
| 4,122,983 | A | 10/1978 | Jolly |
| 4,309,119 | A | 1/1982 | Wittersheim |
| 4,493,704 | A | 1/1985 | Beard et al. |
| 4,668,220 | A | 5/1987 | Hawrylenko |
| 4,676,122 | A | 6/1987 | Szabo et al. |
| 4,691,847 | A | 9/1987 | Ford et al. |

(Continued)

FOREIGN PATENT DOCUMENTS

DE 3446697 A1 6/1986

(Continued)

OTHER PUBLICATIONS

Nguyen, Dinh; Non-final Office Action in U.S. Appl. No. 11/474,744; Mar. 18, 2009; U.S. Patent and Trademark Office; Alexandria, VA.

(Continued)

*Primary Examiner* — Dinh Nguyen
(74) *Attorney, Agent, or Firm* — Stevens & Showalter LLP

(57) ABSTRACT

A cartridge for a handheld electrohydrodynamic (EHD) spraying device and a spraying device incorporating the cartridge. The cartridge is disposable, and can contain therapeutic products. The device includes a wetted lead screw with a compliant seal, where the placement of the seal relative to the screw inhibits leakage during both cartridge use and storage. A frame disposed within the cartridge acts as a load-transferring mechanism for the weight of the cartridge to a handle of the spraying device.

10 Claims, 17 Drawing Sheets

U.S. PATENT DOCUMENTS

| | | | | |
|---|---|---|---|---|
| 4,799,456 | A | 1/1989 | Young | |
| 4,865,591 | A | 9/1989 | Sams | |
| 4,913,172 | A | 4/1990 | Chou | |
| 5,328,486 | A | 7/1994 | Woodruff | |
| 5,454,675 | A | 10/1995 | DeHaitre | |
| 5,492,449 | A | 2/1996 | Hunklinger et al. | |
| 5,531,708 | A | 7/1996 | Woodruff | |
| 5,813,614 | A | 9/1998 | Coffee | |
| 5,820,602 | A | 10/1998 | Kovelman et al. | |
| 5,823,145 | A | 10/1998 | Hingiss | |
| 5,938,642 | A | 8/1999 | Burroughs et al. | |
| 6,022,163 | A | 2/2000 | Asfur | |
| 6,041,976 | A * | 3/2000 | Robertson | 222/333 |
| 6,105,571 | A | 8/2000 | Coffee | |
| 6,221,046 | B1 * | 4/2001 | Burroughs et al. | 604/153 |
| 6,311,903 | B1 | 11/2001 | Gaw et al. | |
| 6,318,640 | B1 | 11/2001 | Coffee | |
| 6,318,647 | B1 | 11/2001 | Gaw et al. | |
| 6,386,195 | B1 | 5/2002 | Coffee | |
| 6,397,838 | B1 | 6/2002 | Zimlich, Jr. et al. | |
| 6,457,470 | B1 | 10/2002 | Coffee | |
| 6,474,219 | B2 | 11/2002 | Klitmose et al. | |
| 6,595,208 | B1 | 7/2003 | Coffee et al. | |
| 6,613,011 | B2 | 9/2003 | Castellano | |
| 6,854,620 | B2 | 2/2005 | Ramey | |
| 6,866,212 | B2 | 3/2005 | Sumiyoshi et al. | |
| 6,964,357 | B2 | 11/2005 | Manganini | |
| 7,673,819 | B2 | 3/2010 | Lind et al. | |
| 2003/0009133 | A1 | 1/2003 | Ramey | |
| 2004/0153032 | A1 | 8/2004 | Garribotto et al. | |
| 2005/0051580 | A1 | 3/2005 | Ramey | |
| 2006/0270987 | A1 | 11/2006 | Peter | |
| 2009/0277970 | A1 | 11/2009 | Lind et al. | |

FOREIGN PATENT DOCUMENTS

| | | | |
|---|---|---|---|
| WO | 0112335 | A1 | 2/2001 |
| WO | 02085530 | A1 | 10/2002 |
| WO | 2004078244 | A1 | 9/2004 |

OTHER PUBLICATIONS

Cernoch, Steven Michael; Non-final Office Action in U.S. Appl. No. 12/306,278; Mar. 9, 2011; U.S. Patent and Trademark Office; Alexandria, VA.

* cited by examiner

HANDHELD SPRAYER WITH REMOVABLE CARTRIDGE AND METHOD OF USING SAME

This application is a divisional application of U.S. Ser. No. 11/474,744, entitled "Handheld Sprayer with Removable Cartridge and Method of Using Same," filed on Jun. 26, 2006, the entire disclosure of which is incorporated by reference herein. This application also claims the benefit of the filing date of U.S. Design Patent Application entitled HANDLE, (Application No. 29/261,411, and U.S. Design Patent Application entitled HANDLE, (Application No. 29/261,452, both filed Jun. 13, 2006.

BACKGROUND OF THE INVENTION

The present invention relates generally to devices for spraying finely dispersed liquids, and more particularly to the use of a disposable cartridge that is compatible with a handheld electrohydrodynamic (EHD) spray device.

Spraying using EHD technology (also referred to as electric field effect technology (EFET)) is a process where fluids or other bulk solutions are dispensed through electrically-charged nozzles. In an EHD spray nozzle, the material to be sprayed flows through a region of high electric field strength made possible by the application of a high voltage to the nozzles and associated nozzle geometry. The high voltage causes the fluid material to acquire an electric charge; the electric field present at the nozzle tips applies a pole to the fluid; the poled fluid charge induces a force that acts in opposition to the surface tension of the material. This surface charge causes the formation of at least one ligament of thin jet of material, causing comminution of the fluid into fine droplets.

One advantage of the EHD process is that high fluid forcing pressures are not required, thereby reducing high-velocity fluid movement and concomitant levels of noise associated with fluid dispersal. As the fluid exits the nozzle, the repelling forces of the surface charge balance against the surface tension of the material, causing the formation of a conical spray pattern (often referred to as a Taylor cone). The tip of the cone has the greatest concentration of charge, and, at that point, the electrical forces overcome the surface tension, generating the thin jet of material that breaks up into charged droplets of generally uniform size. These charged droplets are then readily attracted to the target, adhering readily to it. As portions of the target become coated with the material, the relative electrostatic potential between coated sections and uncoated sections causes subsequent application of the charged material to be preferentially attracted to an uncoated portion of the target, thereby promoting more uniform coverage. The charged nature of the droplets is further beneficial in that their like charge tends to force them to avoid agglomeration. Soon after being deposited on the target, the material loses its charge, leaving an electrically-neutral end product.

EHD technology is a useful way to overcome many of the limitations inherent in other spray application devices, as uneven application, repeated squeezing and releasing of a fluid-dispensing trigger, waste of fluid product and inadvertent exposure of the operator to the fluid material can be reduced or outright avoided. One example of where EHD technology is beneficial is in animal care products, where pesticides and related therapeutic products can be applied easily, accurately and with minimal inconvenience to the operator and the animal being treated. As well, EHD technology may be extended to other uses, including the application of cosmetics, personal care materials and medicaments to animals and humans, as well as the dispensing of fluids for other uses.

One way to further improve the operability of EHD spraying devices is to have the fluid being dispensed be provided in disposable cartridges. Once the product is dispensed, the cartridge can be thrown away and replaced by a new one. This is beneficial in situations where prolonged or excessive exposure to the fluid being dispensed is undesirable, such as with pesticides or other materials used to treat horses and other domesticated animals.

Within the cartridge art are containers in which a generally cylindrical-shaped piston is driven along the length of a complementary-shaped inner wall of the cartridge upon rotation of a lead screw. The lead screw is threaded through the piston and extends into the fluid chamber of the cartridge, and is sometimes referred to as a "wetted" lead screw. Fluid disposed downstream of the piston is forced through an outlet in response to the increasing pressure within the cartridge by piston movement in the downstream direction.

Unfortunately, the above-mentioned cartridge is prone to leakage, especially in regions between the outer periphery of the piston and the inner wall of the cartridge, as well as the threaded space between the screw and the piston. In an application where a cartridge of this type may be used in a device with electronics, the fluid can potentially leak into regions where electronic and other liquid-intolerant componentry resides. As well, when the cartridge or device is being stored during long periods of time during shipping, storage, display or between uses, an unacceptable quantity of fluid may be lost. This problem is particularly acute in situations where the liquid is expensive or hazardous, such as a pesticide, herbicide, flammable materials or the like.

What is desired is a leak-free cartridge, and more desirably, a leak-free disposable cartridge that can be used with an EHD device that is inexpensive to manufacture and easy to dispose of once the contents are dispensed.

BRIEF SUMMARY OF THE INVENTION

These desires are met by the present invention, wherein a cartridge and a method of dispensing a fluid are disclosed. In accordance with a first aspect of the present invention, a cartridge that is configured to cooperate with an EHD sprayer (or spray device) is disclosed. The cartridge preferably includes a body that defines on its inside a substantially closed fluid chamber that has a proximal end (nearest the user) and a distal end in opposition to one another. A lead screw is situated within the fluid chamber, and extends substantially between the proximal and distal ends. In the present context, "substantially" refers to an arrangement of elements or features that, while in theory would be expected to exhibit exact correspondence or behavior, may, in practice embody something slightly less than exact. As such, the term denotes the degree by which a quantitative value, measurement or other related representation may vary from a stated reference without resulting in a change in the basic function of the subject matter at issue. In addition, the cartridge includes a piston defining a bore therein such that the piston is threadably cooperative with the lead screw. With this arrangement, when the lead screw turns, the piston advances toward one end to force at least a portion of a fluid disposed therein out a discharge aperture formed in the cartridge. A seal is disposed in the bore and is threadably cooperative with the lead screw so that fluid leakage between the lead screw and the seal is inhibited. In addition, a fluid outlet is coupled to the fluid chamber such that fluid forced out of the fluid chamber by operation of the lead screw and piston will be discharged through the outlet.

Optionally, the cartridge contains a liquid between the piston and the distal end of the fluid chamber. In another option, the cartridge body is tubular in shape. In the present context, the term "tubular" refers to a hollow shape which has in cross-section a geometrical or irregular form. The tubular body may be either axially elongate or axially squat, where the former refers to the extension of such form substantially along an axis a distance sufficient to define a fluid chamber, and the latter refers to an axial dimension of the fluid chamber that is relatively small when compared to the radial dimension. Additionally, the cartridge includes numerous nozzles that are fluidly coupled to it so that upon the application of force by the moving piston to the fluid, the fluid passes through the nozzles (which may be interconnected along a header or related manifold). For EHD spraying, the pressure necessary to move the fluid is nominal, as needed at a minimum to continuously provide fluid to replace that which is dispensed at what are referred to as Taylor cones formed at the nozzles. The nozzles are preferably fixed to the cartridge such that they may be disposed of or reusable together. This also promotes ease of use. Alternatively, the nozzles may be separable and reusable from the cartridge. The nozzles, manifold or both can be made of a conductive plastic material, using as base materials polymers, for example polycarbonate, high density polypropylene, or preferably polypropylene, acrylonitrile-butadiene-styrene (ABS) and high density polyethylene (HDPE), which can be appropriately compounded as known in the art to exhibit conductive properties. Preferably, such materials exhibit surface resistivity from approximately $10^2$ to $10^{14}$ ohm/square, and volume resistivity of $10^2$ to $10^{14}$ ohm/cm. Alternatively, the nozzles may be made of other electrically conductive (for example, metallic) materials that can be cast or otherwise formed into the appropriate geometry. The nozzles are preferably electrically connected to a high voltage source within the sprayer. In either way, the EHD sprayer can impart the necessary charge to the droplets of liquid that are discharged from the nozzles. As stated above, there are various ways to establish fluid connection between the fluid chamber and the nozzles in such a way as to reduce the likelihood of leakage. In one form, the cartridge includes a septum disposed at the distal end. A cap may also be disposed at the distal end; the cap cooperative with the septum such that upon engagement of the two, the cap forms the aperture in the distal end and forms the sealing force. In another form, a stop-cock is disposed at the distal end to allow for repeated opening and closing of the cartridge. In either form, such act as a closure device configured to keep a liquid disposed within the cartridge from exiting through the distal end.

In a particular form of the cartridge, the seal that is situated between the screw and the piston is preferably made up of a material that is softer than the material of either the lead screw or the piston. Such materials include silicone, rubber, urethane, and like flexible polymers that are compatible for use with a fluid to be dispensed from the cartridge and have the necessary properties to seal against the wetted lead screw in accordance with the present invention. In another option, the cartridge further comprises a frame configured to provide axial and radial support to the lead screw. More particularly, the frame is connected to the fluid chamber such that the frame inhibits movement of the lead screw toward one end (for example, the proximal end) of the cartridge. In one configuration, the frame is made up of a central hub from which numerous radially-extending spokes contact the inner wall of the fluid chamber. In such form, the frame supports and centers the screw as the piston advances.

According to another aspect of the invention, an EHD spray device is disclosed. The device includes a fluid dispensing cartridge with a body defining a substantially closed fluid chamber configured to contain a fluid, a lead screw, piston and seal disposed within the fluid chamber, a handle comprising a rotational power source and a high voltage electrical source, a spray manifold in fluid communication with the cartridge and numerous nozzles in fluid communication with the spray manifold. One or both of the manifold and the nozzles are electrical communication with the high voltage electrical source. In this way, upon application of a voltage to the manifold, nozzles or both, at least a portion of the fluid being discharged from the nozzles is comminuted. The manifold is preferably designed to maintain substantially equal flow to each nozzle, however, the cartridge of the present invention does not depend on such flow being substantially equal, and may be used with other nozzle configurations to achieve EHD spraying with various characteristics. The handle preferably includes the power supply (for example, one or more batteries), motor, voltage multiplier, drive mechanism for the lead screw, and controller components. In alternative configurations where the cartridge is not detachable from the handle, the handle may include any combination of the power supply, fluid reservoir, pump, or controller/processor.

Optionally, the handle comprises a grip for engaging a user's hand. In the present context, the grip is the portion of the handle that comes into contact with the user's hand. At least a portion of the grip (such as the trigger or related control member) can be made from a material such as a metal, an electrically conductive plastic, electrically conductive polymer, electrically conductive rubber or combination thereof This facilitates grounding of the spray device through the user. The trigger can be used to commence and halt operation of the spray device. In another option, a longitudinal dimension of the handle and a longitudinal dimension of the cartridge are substantially aligned along a common longitudinal axis, while in another, they are angularly disposed relative to one another in an offset manner, thereby enhancing ergonomic features of the spray device. In the offset configuration, the angle formed between the longitudinal dimensions is up to thirty degrees. In either configuration, the center of gravity of the cartridge and the handle is located along a segment of the grip during at least a portion of operation of the spray device, thereby improving balance. The cartridge may be rotatably positionable about its longitudinal axis such that a preferred spraying pattern made be employed while keeping the user's hand position relatively constant. The cartridge can be rotated in angles of up to plus or minus ninety degrees from a neutral position (i.e., the position assumed by the cartridge upon normal connection with the handle of the spray device). The spray device may further include a frame substantially similar to that described previously. An interface defined between the cartridge and the handle may include a load-bearing mounting surface on the handle that cooperates with a complementary surface on the frame such that at least a portion of the force acting on the piston and screw during operation is not transmitted to the drive mechanism, but is carried by the load-bearing mounting surface. This can result in smaller, simpler components being used in the cartridge. Optional complementary surfaces disposed on the driver and the lead screw allow self-adjusting connection between them.

The cartridge can be equipped with one of various forms of discharge closure means, examples of which include a septum or a stop-cock valve (the latter formed in an end cap) and operable to either establish fluid flow or seal the cartridge as previously discussed, either of which are placed at the distal end of the fluid chamber to prevent leakage or spillage of the liquid when the device is not in use. This is especially valuable in situations where highly concentrated fluids are placed in the cartridge. The spray manifold is electrically conductive, and is in fluid communication with the discharge aperture. In addition, the nozzles can be made electrically conductive, and in fluid communication with the spray manifold. In another form, the nozzle tips themselves do not have to be electrically conductive. The nozzle could be nonconductive with a conductive coating on the outside or inside to help establish the proper electric fields. Where the formulation of the fluid is sufficiently conductive, it would be enough that the high voltage contact the fluid somewhere upstream of the nozzles. Optionally, the handle includes a grip made from a metal, an electrically conductive material including electrically conductive plastic, electrically conductive polymer, electrically conductive rubber, and combinations thereof In another option, the remainder of the handle could be made from the same materials as the grip.

According to still another aspect of the invention, a method of spraying a fluid is disclosed. The method includes connecting a fluid-containing cartridge to a sprayer, and rotationally moving a wetted lead screw in the cartridge to dispense the fluid. Optionally, the spray device comprises a spray manifold and numerous nozzles, as well as an electric power source configured to provide rotational power and high voltage to one or both of the spray manifold and the nozzles such that upon the dispensing of the fluid, the high voltage imparts a charge to the fluid flowing through the nozzles, causing at least a portion of the dispensed fluid to be comminuted. By rotationally moving the lead screw, the fluid disposed in the cartridge is forced out; such can be controlled by the user through a control (such as a trigger or related switch). The cartridge may be rotatably adjusted about its longitudinal axis relative to the spray device.

According to another aspect of the invention, a spray device including a handle and a cartridge is disclosed. The handle defines a grip thereon and includes an electric power supply, a motor coupled to the electric power supply, a control member configured to electrically connect the electric power supply and the motor, and a driver rotationally coupled to the motor. The cartridge is supported by the handle through a cantilevered connection between them, and includes a body defining a fluid chamber, a plunger disposed in the fluid chamber and responsive to the driver, and numerous nozzles in fluid communication with the fluid chamber. Movement of the driver causes corresponding movement of the plunger, which in turn causes at least a portion of the fluid to be discharged in a spray pattern substantially defined by the nozzles. The plunger is connected to the handle at an interface defined by the driver.

Optionally, the spray device comprises a voltage multiplier circuit, as well as a connection to establish electrical communication between the voltage multiplier circuit and the nozzles. In this way, a charge field is set up that is sufficient to comminute the fluid being dispensed from the nozzles. The cartridge may further include a frame to promote the cantilevered connection between the cartridge and the handle. The frame may include a mounting surface that engages a complementary surface on the handle such that most (if not all) of the weight associated with the cartridge is carried through a connection formed by the engagement of the surfaces. The driver may include a female fitting that engages a complementary male projection extending from the plunger, where teeth disposed about a substantial inner periphery of the female fitting promote the engagement. The cartridge may define a substantially longitudinal axis (such that the cartridge takes on a generally tubular shape). In such a configuration, the spray pattern is in a direction substantially transverse to the longitudinal axis of the cartridge.

BRIEF DESCRIPTION OF THE SEVERAL VIEWS OF THE DRAWINGS

The following detailed description of the present invention can be best understood when read in conjunction with the following drawings, where like structure is indicated with like reference numerals and in which.

DETAILED DESCRIPTION OF THE PREFERRED EMBODIMENTS

Figure 1:
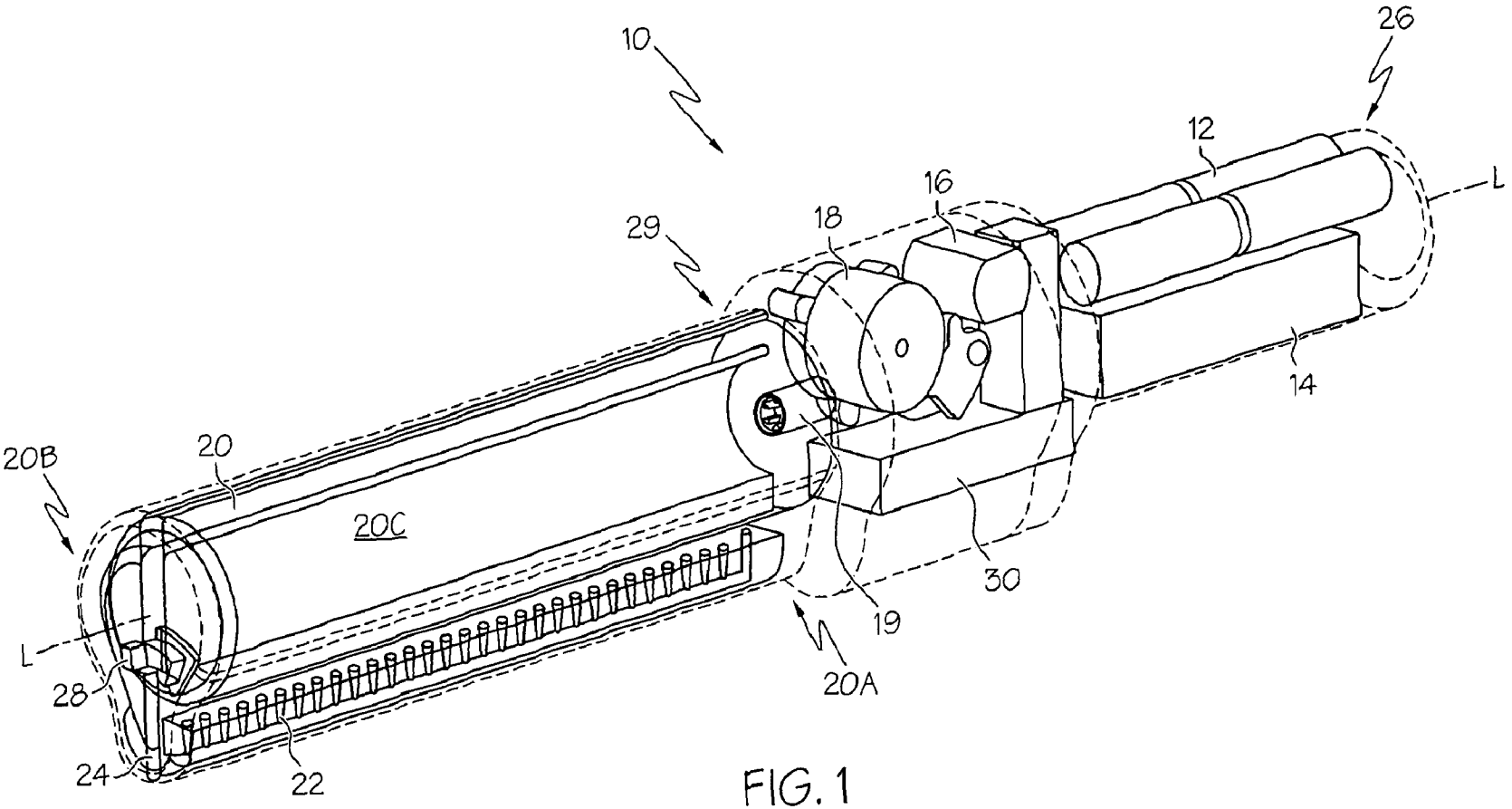
FIG. 1 shows a cartridge according to an aspect of the present invention, and connection of the cartridge to an EHD spray device.
Figure 13:
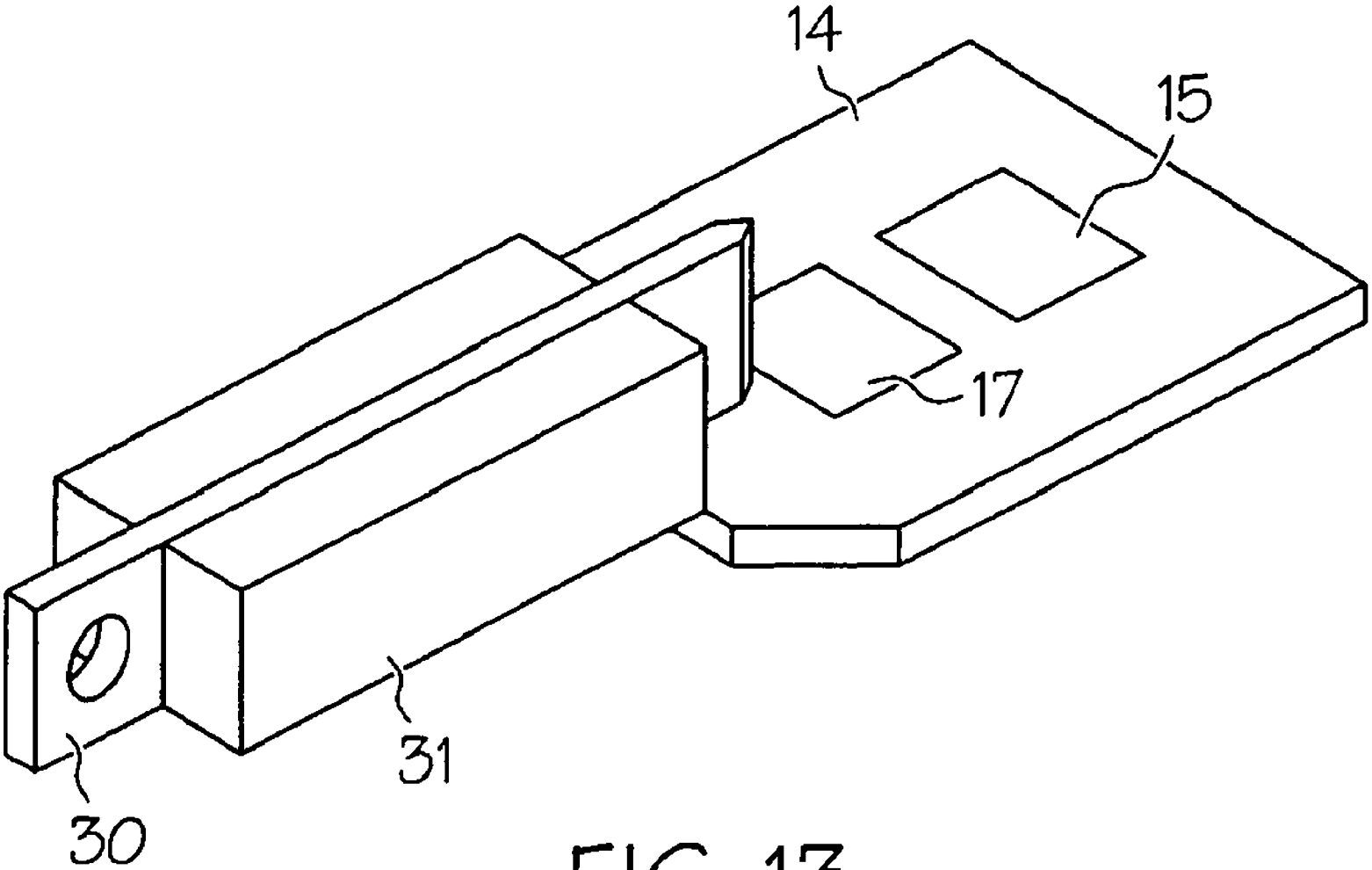
FIG. 13 shows a converter that can be situated within the handle of FIG. 1 or 12.

Referring first to FIGS. 1 and 13, a sprayer 10 includes a handle 26, a cartridge interface 29 and fluid-containing cartridge 20. An array of nozzles 22 are situated beneath cartridge 20, and are in fluid communication therewith to dispense a fluid. The handle 26 is used to house a power supply 12, a converter (also referred to as an electronics or circuit board) 14, a motor 16, a drive mechanism 18 and driver 19, and a high voltage multiplier 30 (also referred to as a voltage multiplier circuit). In the present context, the term "high voltage" and its variants is used to represent increases in voltage over that provided by the power supply 12 due to the operation of the voltage multiplier 30, rather than as indicia of a particular voltage level. By way of example, for a voltage measured at the output of the power supply 12 of six volts, a voltage of thousands of volts measured at the output of the voltage multiplier 30 would constitute a high voltage. The power supply 12 may comprise a portable, on-board voltage supply, such as through a set of batteries, for example four AA batteries, which may or may not be rechargeable. As shown with particularity in FIG. 13, converter 14 includes a processor 15, transformer 17 and potting material 31, the last to encase the multiplier 30 to provide insulation for the high voltage emanating therefrom. The converter 14 acts to step up the voltage from the power supply 12 to a higher level in order that it may (among other things) power the multiplier 30. The multiplier 30, in turn, converts the voltage from the converter 14 to a level suitable for comminuting a liquid contained within the cartridge 20 with EHD forces. The multiplier 30 may be configured as a flyback oscillator circuit as understood by those skilled in the art. In an exemplary form, converter 14 (with transformer 17 and multiplier 30) can take an input voltage of between four and six DC volts and convert that to between twenty thousand and thirty thousand DC volts. An electrical connection (not shown) between the multiplier 30 and the nozzles 22 enables a necessary charge to be formed on the latter such that when fluid passes therethrough, it is comminuted. Cartridge 20 includes generally opposing ends: a proximal end 20A that is adjacent to and cooperative with the cartridge interface 29, and a distal end 20B through which the fluid to be dispensed flows. The interior 20C of cartridge 20 defines a fluid chamber between the proximal and distal ends 20A, 20B. Cartridge 20 is preferably disposable and not reusable.

Figure 2:
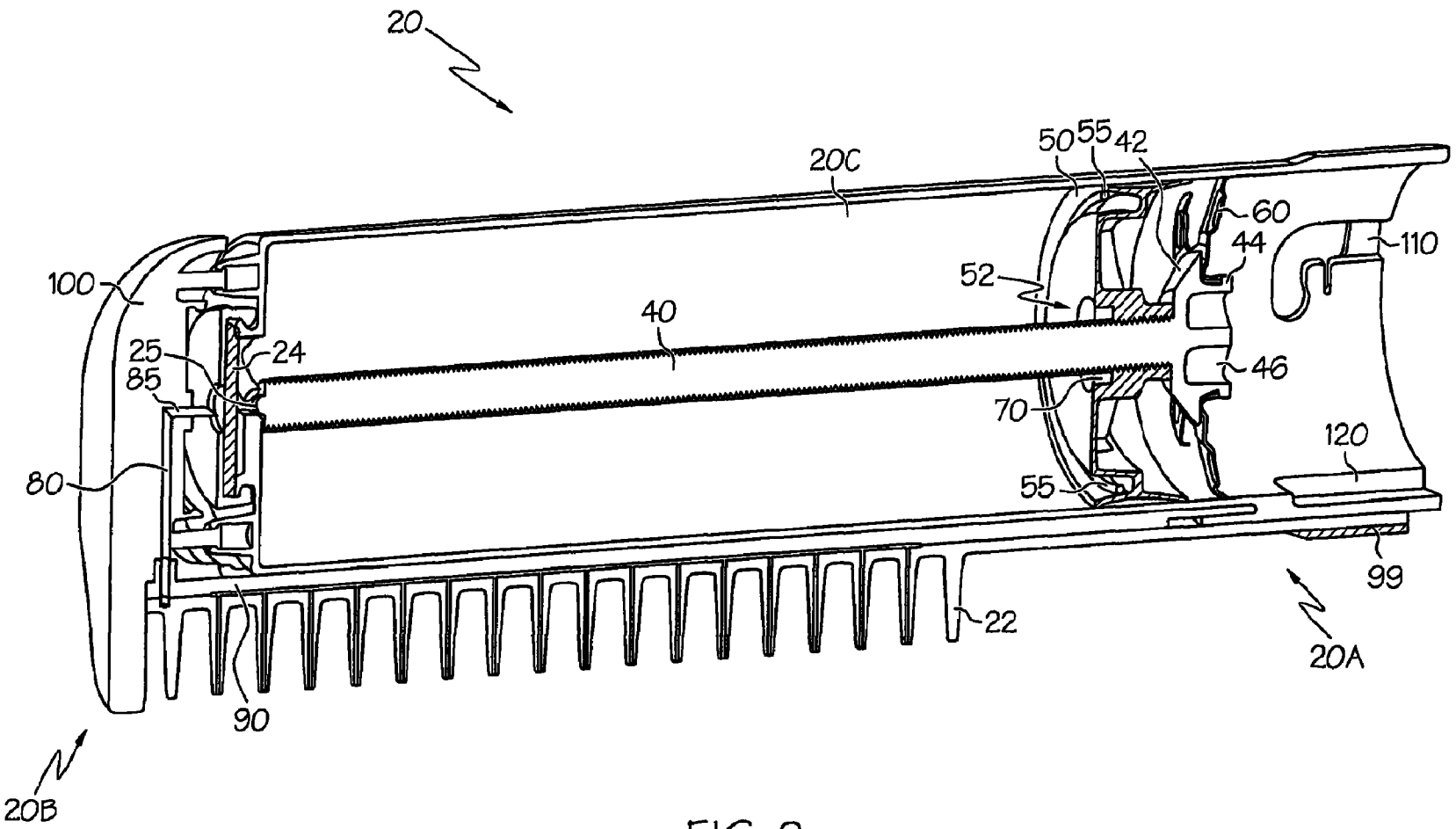
FIG. 2 shows a perspective cutaway view of the cartridge of FIG. 1 with a cap placed adjacent a distal end of the cartridge.
Figure 3:
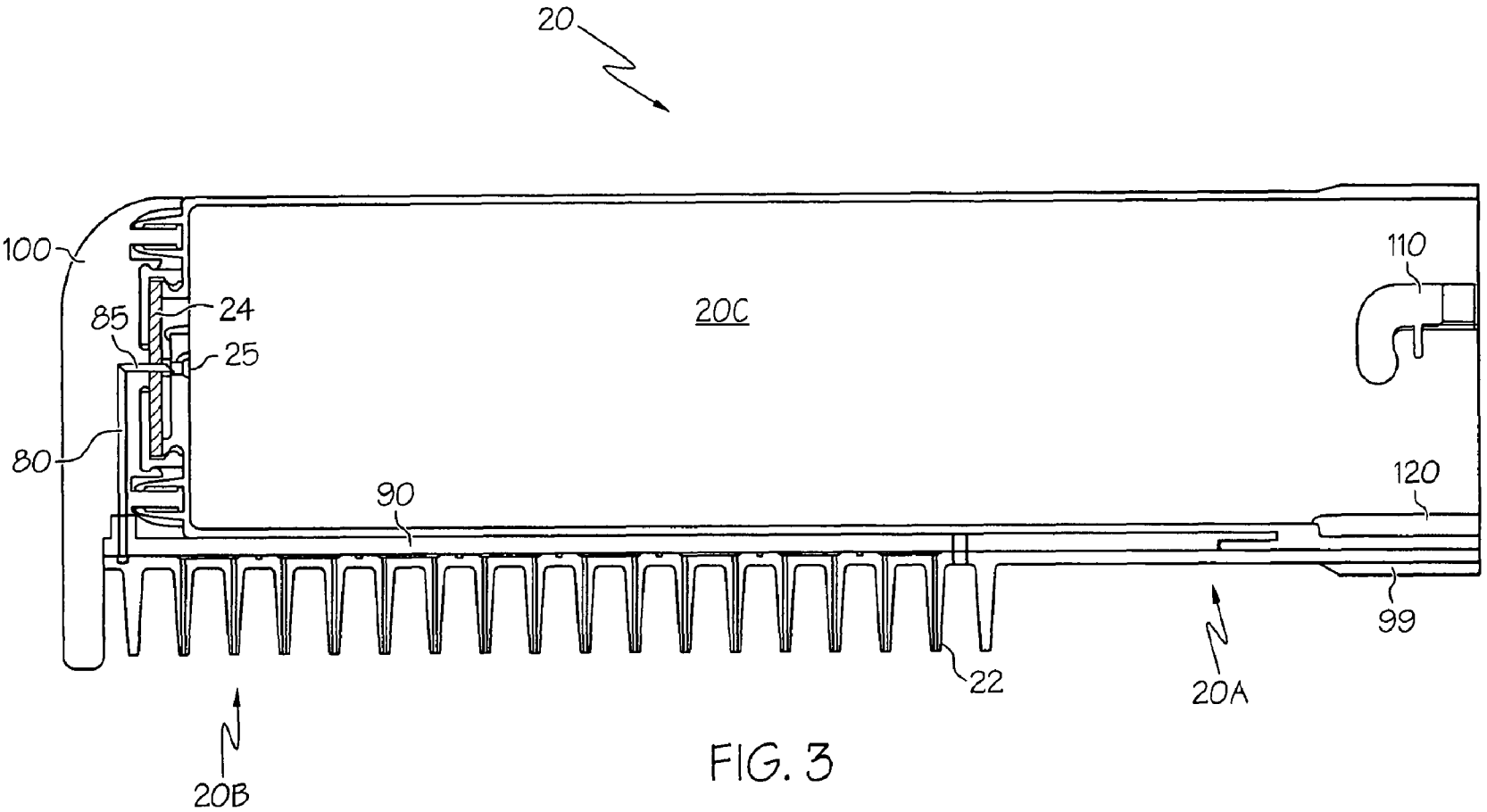
FIG. 3 shows a side cutaway view of the cartridge of FIG. 1 with the wetted lead screw, piston, seal and frame removed.

Referring to FIGS. 2 and 3, cutaway views showing the cartridge with (FIG. 2) and without (FIG. 3) internal componentry is shown. The cartridge 20 and the cartridge interface 29 are adapted to enable the cartridge 20 to attach and detach quickly, easily, and without spillage of contained liquid. The inside (fluid-containing) portion of cartridge 20 is bounded at its proximal and distal ends 20A, 20B by a piston 50 and a septum 24, and radially by the inner wall 20C such that a fluid chamber is defined. Septum 24 forms a closure barrier at the distal end 20B of cartridge 20, and can be punctured by a needle 85 formed into discharge tube 80 that makes up a part of cap 100. Needle 85 may be configured as a syringe needle, while septum 24 is made from a material (such as rubber) that substantially self-seals. To promote the piercing of septum 24 by needle 85, cap 100 needs to be snapped fully in place. As will be noted, the cap 100 in FIG. 2 is not snapped fully in place, such that needle 85 has not poked a hole in septum 24, whereas in FIG. 3, cap 100 is shown snapped fully in place such that needle 85 pierces septum 24 to produce the aperture 25 that enables the flow of liquid from the fluid chamber to the header 90.

Fluid that is forced out of cartridge 20 passes through discharge tube 80 and into manifold 90, where a series of channels (shown and described in more detail below) distribute the fluid to the nozzles 22. To promote EHD operation, high voltage from handle 26 is imparted to at least one of the manifold 90 and nozzles 22 so that an adjacent charge field to act upon the fluid. An electrical connection 99 is used to establish electrical continuity between the power source 12 and associated voltage multiplying components situated on converter 14.

Piston 50 is mounted onto a wetted lead screw 40. While the screw 40 can be made from any suitable structural material, in a preferred embodiment it is made of plastic. Threads on both cooperate with each other such that upon rotation of screw 40, piston 50 progresses from the proximal end 20A to the distal end 20B. While the direction of travel of the piston 50 towards the distal end 20B as described above is preferred, it is not intended to limit the scope of the invention described herein. As such, it will be appreciated by those skilled in the art that the cartridge 20 may be designed so that the wetted lead screw 40 drives the piston 50 from the distal end 20B towards the proximal end 20A of the fluid chamber. A relatively snug fit between the outer periphery of the piston 50 and the inner wall 20C prevents the piston 50 from sympathetically turning with the lead screw 40. It will be understood by those skilled in the art that other anti-rotation features may be employed, such as an axial key and slot arrangement formed in the piston and cartridge inner wall, or by forming the inner wall and piston with complementary oval or other non-axisymmetric shape. While it is preferable that the piston not rotate in relation to the inner wall 20C, in some applications the piston may rotate slightly in relation to the bore wall, but at a rate slower than the lead screw. The construction of piston 50 is such that it acts like a plunger in that it pushes fluid situated on its downstream portion out of a container, vessel or chamber to which the plunger is attached. Retaining ring 55 may be disposed substantially about the periphery of piston 50 to promote rigidity and shape retention. Cartridge 20 may optionally include a window, or be made of a transparent or translucent material (none of which are shown) to provide a visual dose cue to indicate the volume of fluid or number of doses remaining Other indicia, such as an auditory application cue (not shown) through timed sounds linked to volume dispensing rate could also be used.

A seal 70 is situated between an axial bore 52 formed in the piston 50 and the threads of screw 40. As with the piston 50, seal 70 may include threads on its inner bore so that the seal 70 can cooperate with the rotational movement of screw 40. In order to maximize its sealing feature, seal 70 is preferably made from a softer material than that of the screw 40 or piston 50. This results in a more compliant form that can better maintain small gaps between the seal 70 and the threads of the screw 40, thereby reducing the possibility of backwards leakage along the screw 40. Examples of seal material can be a silicone-based or plastic-based structure. In one form, the seal 70 can be integrally manufactured into piston 50 to ensure a leak-free connection.

Figure 7A:
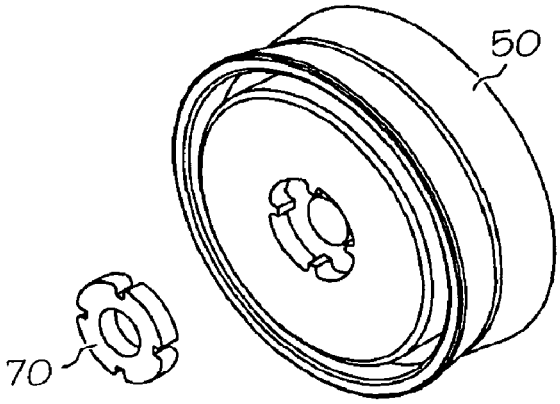
FIG. 7A shows a perspective view of the piston and seal of FIG. 1.
Figure 7B:
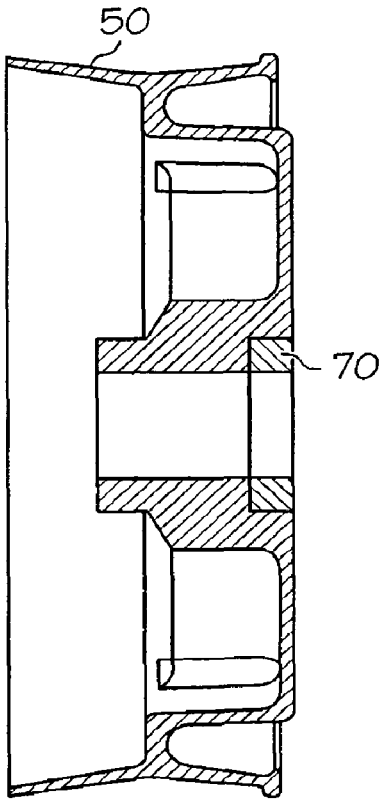
FIG. 7B shows a reversed side cutaway view of the piston and seal of FIG. 7A, presently shown without a retaining ring.
Figure 8A:
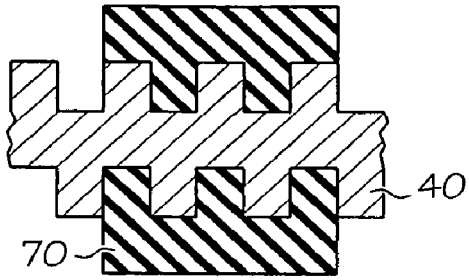
FIGS. 8A through 8C show various embodiments of the engagement of the wetted lead screw and the seal.
Figure 8B:
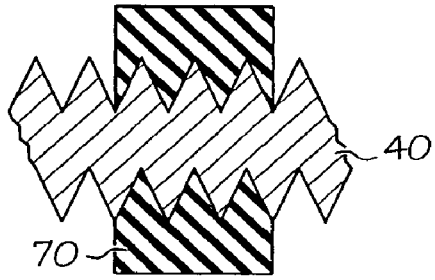
Figure 8C:
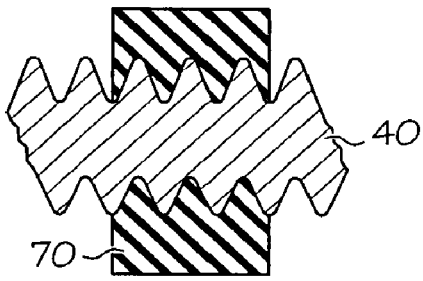

For best sealing properties, the seal 70 is manufactured or molded to match the thread design of the wetted lead screw 40. As shown in FIGS. 8A through 8C, by way of example and not limitation, these may be cut threads, rolled threads, squared threads, sinusoidal threads or other thread designs. Unified lead threads are preferred for ease of manufacture of the seal 70. With reference to FIGS. 7A and 7B, this structure may be produced by separately manufacturing or molding the seal 70 for insertion into piston 50, or by molding the seal 70 in place in the cavity of the piston 50, which is preferred.

Figure 9:
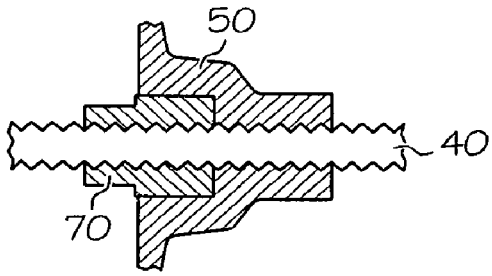
FIG. 9 shows an alternate embodiment of the seal.

The seal designs of FIGS. 8A through 8C can be augmented with a self-actuating sleeve formed as a projecting portion of seal 70, shown for example in FIG. 9. Such a configuration extends into the fluid chamber along the wetted lead screw 40, so that as the pressure of the fluid in the fluid chamber increases, the seal 70 compresses more tightly against the lead screw 40 to increase sealing pressure against leakage. The sealing pressure of the sleeve may be enhanced by producing the sleeve with a slight inward taper, provided the taper is not sufficient to block the travel of the wetted lead screw 40. The length, taper and flexibility of the sleeve will control the sealing pressure thus applied by the seal material as it is stretched over the wetted lead screw 40. The sleeve design is not preferred, as the added friction draws more power and tends to add cost to the cartridge and sprayer by requiring stronger parts, and a larger motor. Modifications of the spraying device 10 for electrospraying would include a larger motor 16 to generate higher pressures, corresponding strength in the fluid chamber and piston 50, as well as to smaller apertures or related orifices.

In another alternative design (not shown), seal 70 may be made without a thread design manufactured or molded therein. In this form, seal 70 may be formed from a relatively soft elastomer sleeve that could engage the threads of lead screw 40. The compliant nature of the sleeve would allow the sleeve to work its way into the threads as the lead screw 40 repeatedly passes over the sleeve. In such a design, the threads of the wetted lead screw 40 may be very fine, for applications where shorter travel per revolution of the wetted lead screw 40 is desired. The material of seal 70 is softer than that of the wetted lead screw 40 and piston 50, so that seal 70 is squeezed into the threads of the wetted lead screw 40 to seal against leakage. Again, this further alternative design is not preferred, as the sleeve compression on the fine threads adds friction and more revolutions are required per inch of travel for the wetted lead screw 40, all of which draws more power and tends to add cost to the cartridge and sprayer by requiring stronger parts and a larger motor.

Figure 5A:
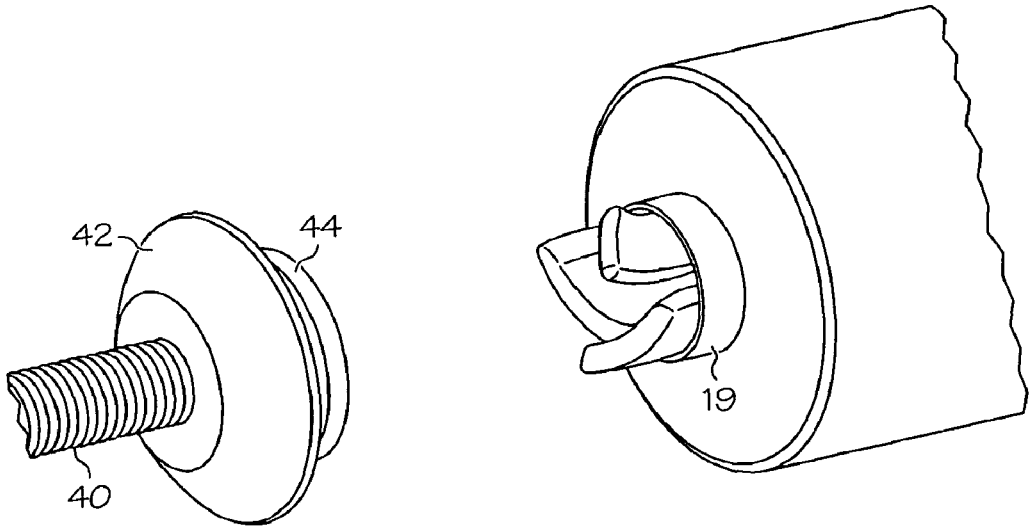
FIG. 5A shows a first perspective view of the connection of the wetted lead screw to the driver of a sprayer handle.
Figure 5B:
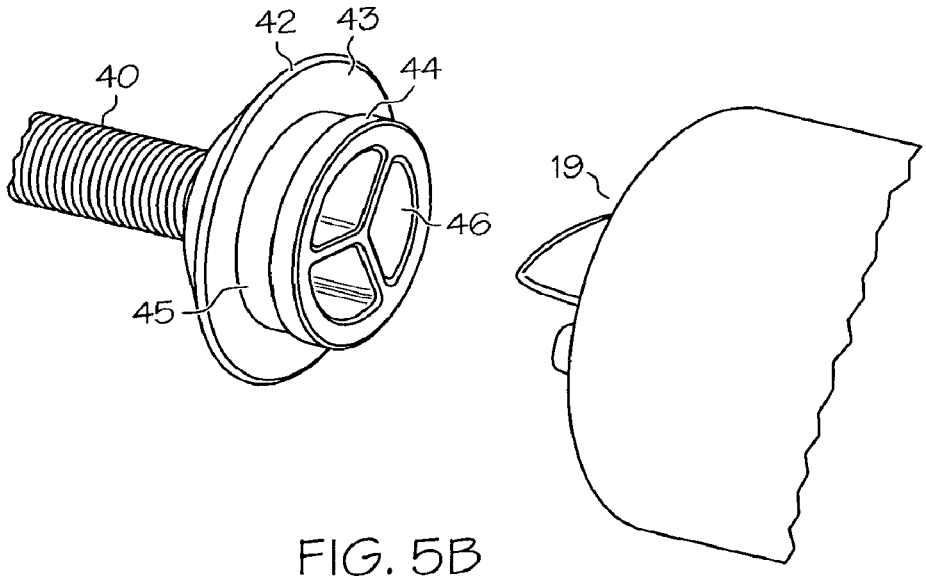
FIG. 5B shows a second perspective view of the connection of the wetted lead screw to the driver of a sprayer handle.
Figure 5C:
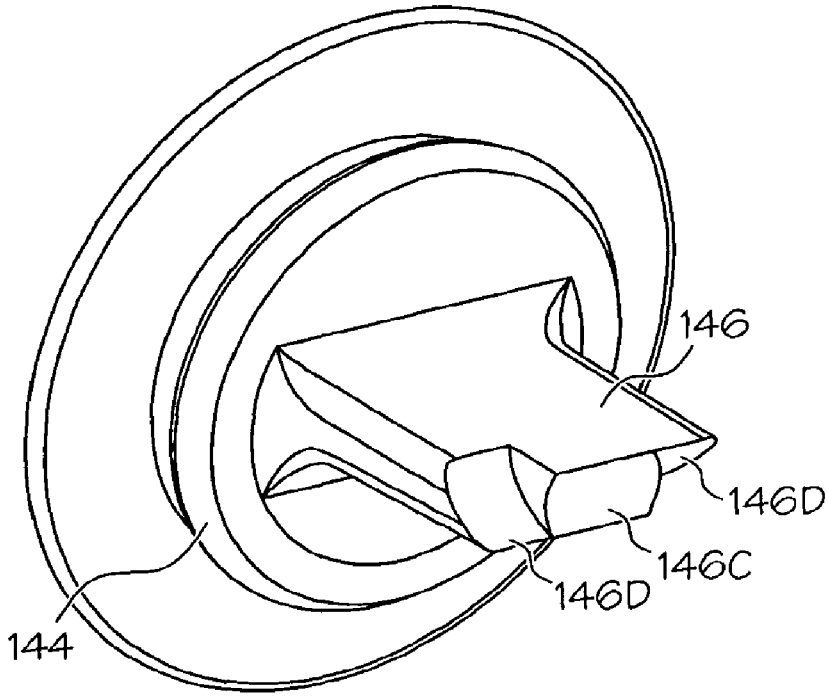
FIG. 5C shows a perspective view of an alternative embodiment of a hub for the wetted lead screw.
Figure 5D:
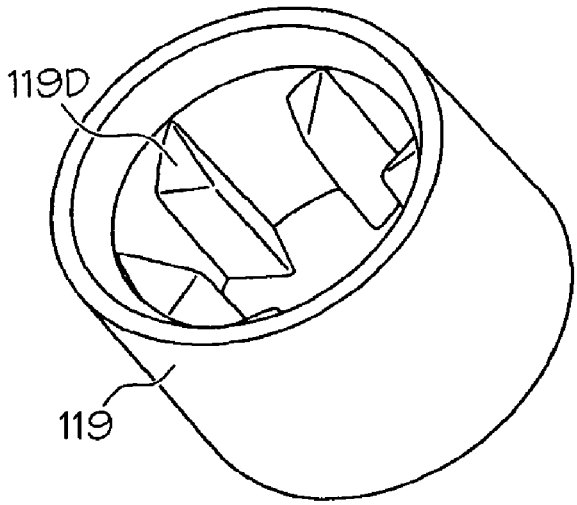
FIG. 5D shows a perspective view of an alternative embodiment of the driver that could be coupled to the hub of FIG. 5C.
Figure 6:
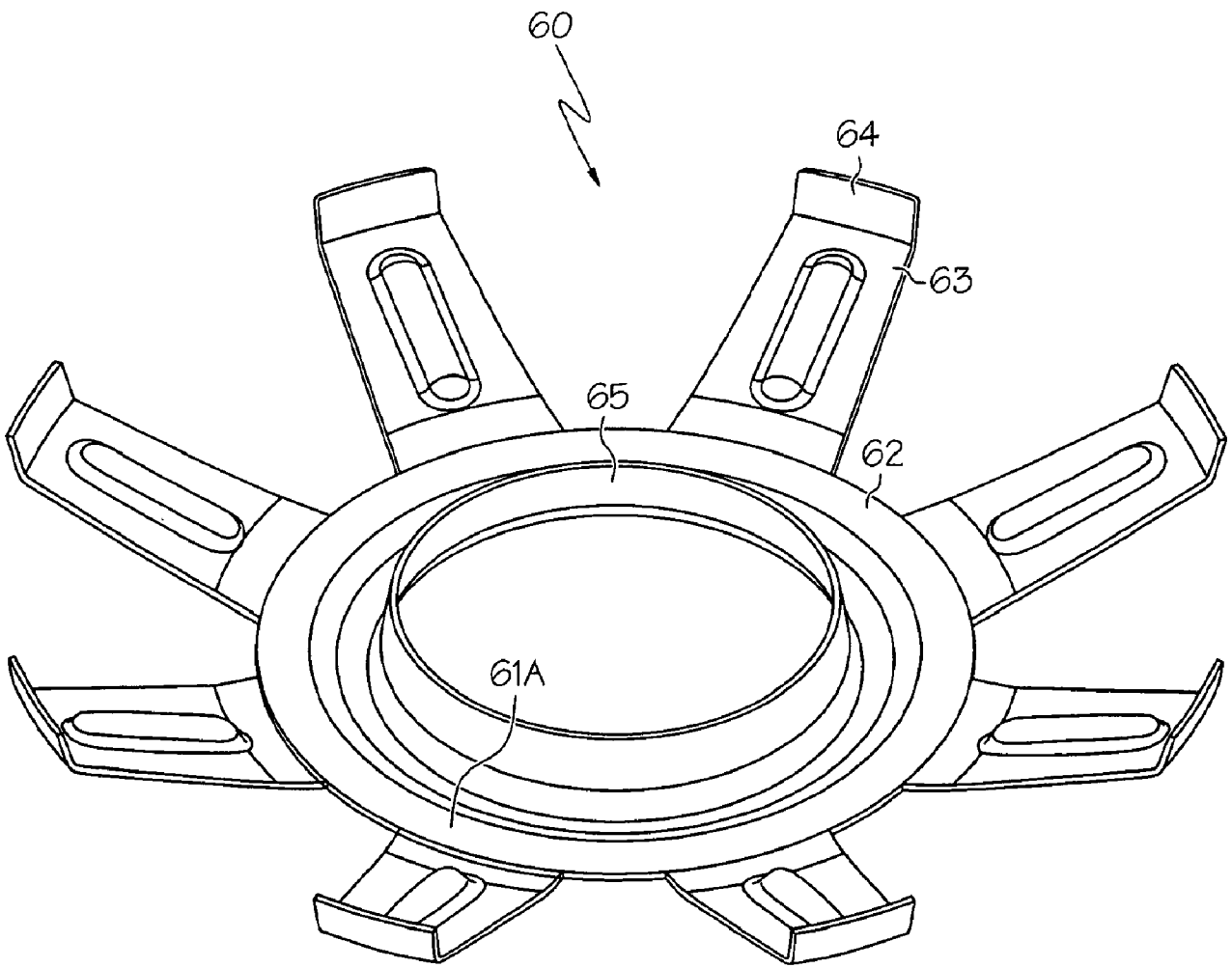
FIG. 6 shows the frame that is used to support the wetted lead screw in the cartridge.

Referring again to FIG. 2, and further in conjunction with FIGS. 5A through 5D and 6, screw 40 extends from one end of the fluid chamber to the other. Referring with particularity to FIGS. 2, 5A and 5B, a proximal end of screw 40 fans out to define a hub 42, while at its distal end, screw 40 preferably has a ball end supported in a socket. Connectors to the ball and socket arrangement, such as conical and other like connectors known in the art may be used. Alternatively, the screw 40 may be cantilevered, supported at the one end and by the piston 50 and frame 60. To keep screw 40 radially centered in the fluid chamber and aligned with the driver 19, hub 42 is mounted to a frame 60. Referring with particularity to FIG. 6 in conjunction with FIG. 2, frame 60 assumes a spider-like (i.e., hub-and-spoke) shape with a ring 62 defining a central race 65, and a plurality of radially-extending legs 63 that terminate in feet 64. In this way, ring 62 acts as a hub, while the individual legs 63 act as spokes that connect the hub to the inner wall 20C of the fluid chamber. The central race 65 of frame 60 is configured to rest upon the corresponding race 45 formed in hub 42 (discussed in more detail below). Their cooperative nature allows them to act as a bearing such that screw 40 can rotate relative to the frame 60. Preferably, the frame 60 is made from a relatively rigid material, such as metal. The legs 63 are axially canted, while the feet 64 are additionally canted; this gives the frame 60 spring-like qualities to promote insertability into the fluid chamber of cartridge 20. By having the legs 63 and feet 64 be backwardly-biased, the frame 60 inhibits backward movement of the screw 40, as any attempt to push the frame 60 rearward (i.e., toward the proximal end) will cause feet 64 to splay radially outward, thereby digging into the relatively soft inner wall 20 and inhibiting additional movement.

Various rotational couplings between the driver 19 and wetted lead screw 40 are shown. Drive mechanism 18 (shown in FIG. 1) and driver 19 form a coupling at the end of a shaft on motor 16, and can rotate about the generally elongate axis L of the sprayer 10. Referring with particularity to FIGS. 5A and 5B, hub 42 includes an anterior surface 43, posterior ridge 44 and race 45. The end of hub 42 forms a multicompartmented female portion 46 that engages the male projection of driver 19. The structure of hub 42, with its race 45 that is of a smaller radial dimension than the axially adjacent anterior surface 43 and posterior ridge 44, is such that the central race 65 of frame 60 (shown in FIG. 6) can be made to fit onto the race 45 of hub 42 by snap-fit or similar connection. The drive mechanism 18 and driver 19 convey rotational motion from the motor 16 to the lead screw 40, and as may be appreciated by those skilled in the art, can also include various gearing and belt arrangements, as well as a linear drive motor arrangements to impart the necessary rotational motion. Referring with particularity to FIGS. 5C and 5D, an alternate embodiment of hub 142 includes an anterior surface 143, posterior ridge 144 and race 145. Unlike the hub 42 of FIG. 5A, hub 142 includes a male projection 146 having angled or angled arcuate surfaces 146D (in addition to generally square surfaces 146C). A complementary female fitting in the driver 119 defines an inner periphery (such as in the form of a race) that has gear-like teeth disposed about an inner periphery of such race. The top surfaces 119D of the teeth are also angled or angled arcuate surfaces. When male projection 146 from hub 142 is inserted into the female fitting of driver 119 so that the surfaces 146D and 119D contact, these surfaces deflect to cause the cartridge 20 to automatically adjust by slight rotation or similar clocking motion for proper connection. This provides a self-adjusting feature for the handle 26 and cartridge 20. In one form, the clocking motion is typically no more than approximately fifteen degrees.

In one form, a bayonet-type attachment 110 may be employed, as well as a keyed slot 120 to ensure proper alignment between the cartridge 20 and the handle 26 of sprayer 10. Such an attachment ensures quick connection and removal. The bayonet-type attachment 110 may be disposed on both sides of cartridge 20, so long as both can be engaged or disengaged simultaneously by relative rotation in one direction or the other between the cartridge 20 and handle 26. An example of such connection can be seen in FIGS. 2, 3, 16 and 17. Alternatively, a twist-type attachment (not shown) with a positive or friction lock, a spring mounted pin and hole arrangement (not shown), or other means for positively connecting the cartridge to the handle would be suitable. A further feature of the mechanical interface is that the surface 61B is a load bearing surface which transfers the operational forces acting upon the lead screw 40 of the cartridge 20 to the handle 26 when it is assembled to the handle 26. Surface 61B contacts surface 61A of the frame 60 (as shown in FIG. 6) to this end to minimize the load applied to the drive mechanism 18 and driver 19 and related internal components in the handle. The cartridge 20 and handle 26 are preferably detachable, so that cartridge 20 may be disposable (or refillable), or so that one cartridge may be exchanged for another having a different fluid. The handle interface 29 thus includes both mechanical and electrical interfaces.

Figure 12:
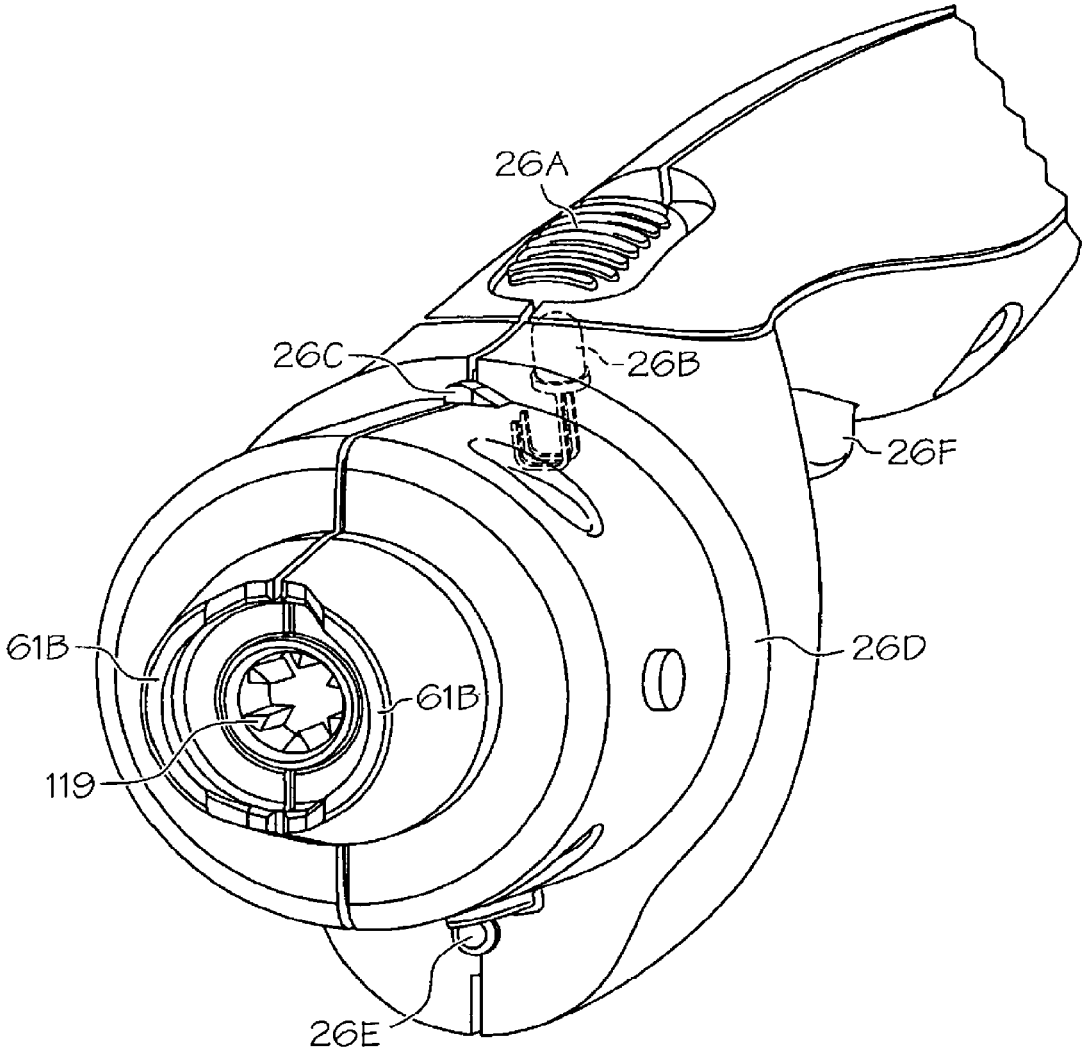
FIG. 12 shows a view of an alternate embodiment of a handle used to connect to a cartridge.

Referring next to FIG. 12, in one form, the handle 26 can be ergonomically designed to minimize leverage on the hand, wrist, and/or forearm of a user. An on/off switch 26A is used to provide power to the cartridge 20. When switch 26A is in the "on" position, a light-emitting diode (LED) 26B lights up to indicate operational status. The switch 26A may control, singly or in combination, activation of indicators (such as LED 26B), the motor 16, and the multiplier 30. An activation switch 26C is placed just ahead of seating surface 26D such that unless activation switch 26C is depressed (such as by the presence of a cartridge 20 placed against the seating surface 26D at the location designated as interface 29), connection between the high voltage coming from the multiplier 30 to contact 26E (which electrically connects to connector 99 of manifold 90) is not made, thereby preventing open exposure of a "hot" lead from the handle 26. Trigger 26F is to give the user control over the supply of electricity to the motor 16. In an alternate form, activation may be provided by trigger 26F on the grip, instead of by the on/off switch 26A. In yet another form, the grip itself, minus the trigger, could be used to activate the sprayer 10.

Figure 14:
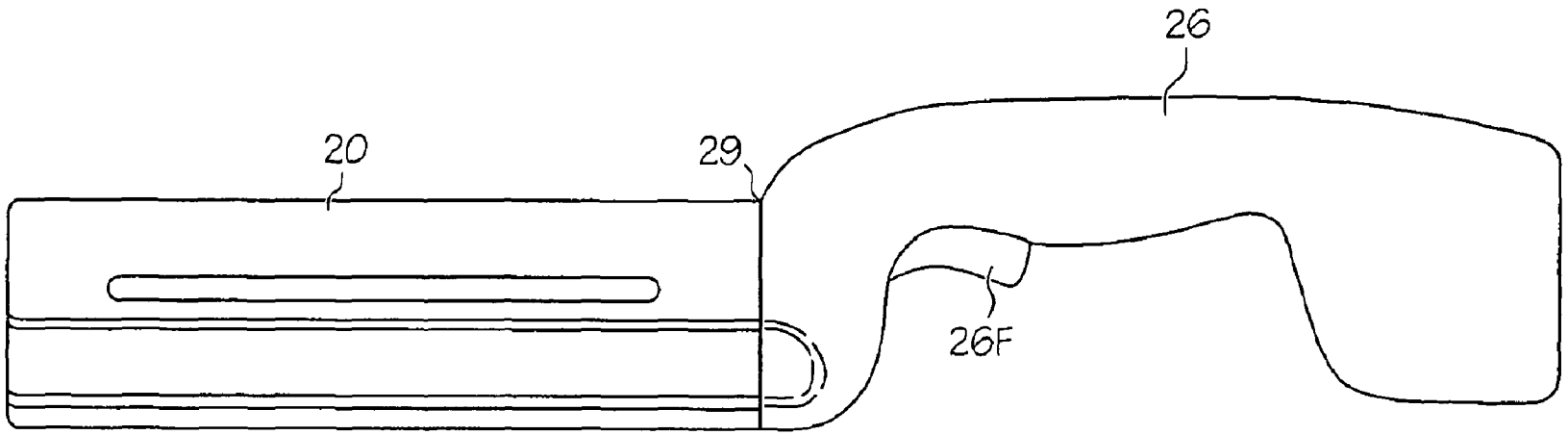
FIG. 14 shows a side elevation view of the handle of FIG. 12 connecting to a notional cartridge.
Figure 15:
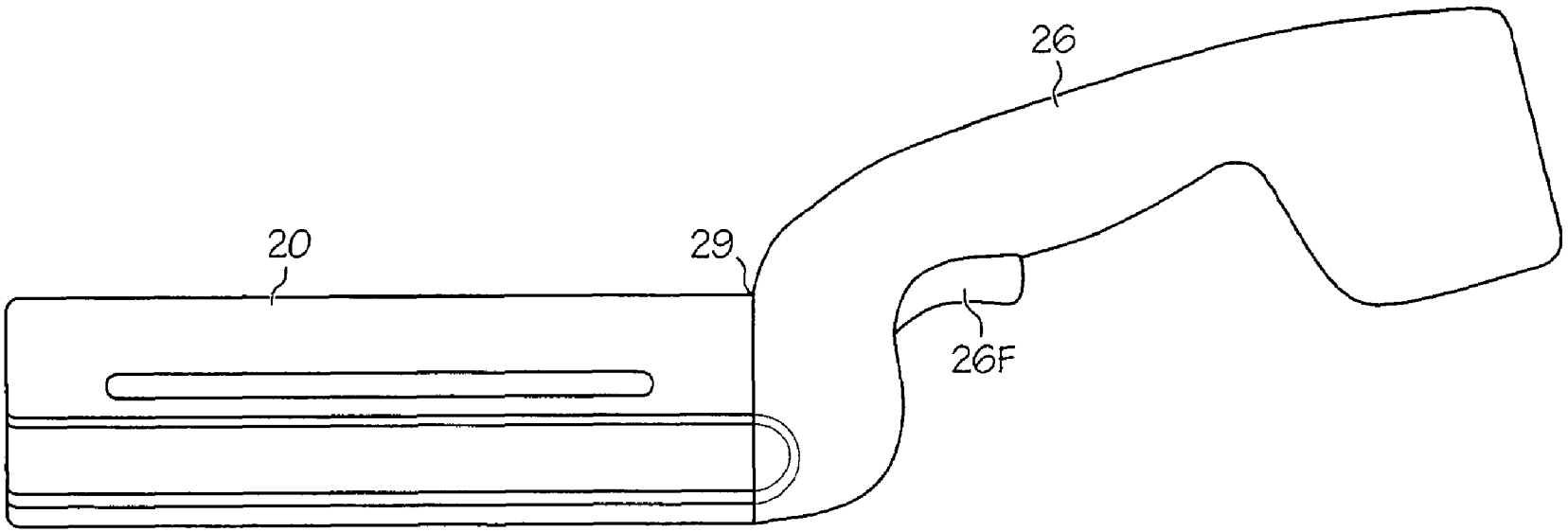
FIG. 15 shows an alternate embodiment of the handle, now angled relative to the cartridge to which it is connected.
Figure 16:
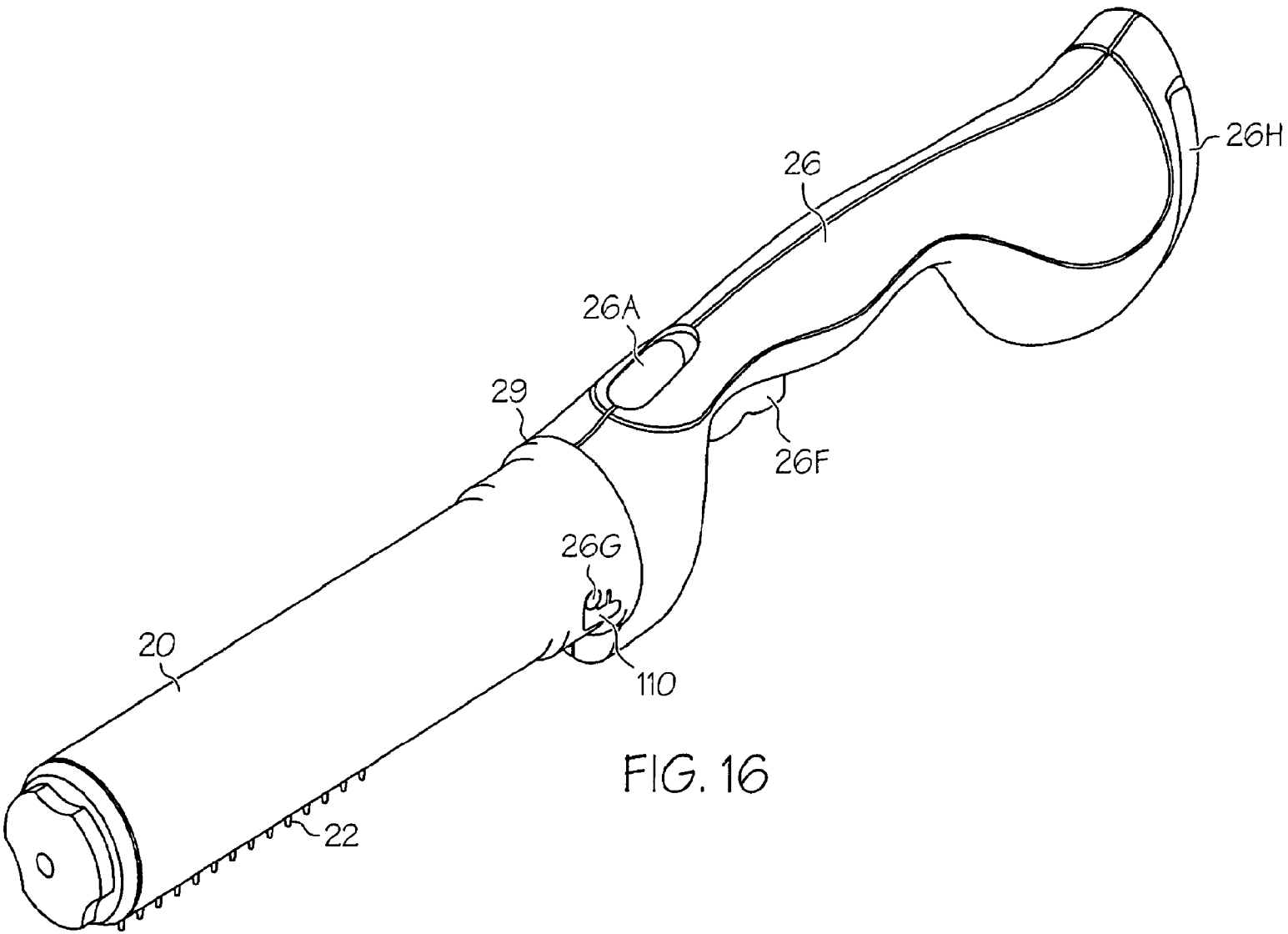
FIG. 16 shows a perspective view of the attachment of yet another handle embodiment to a cartridge.
Figure 17:
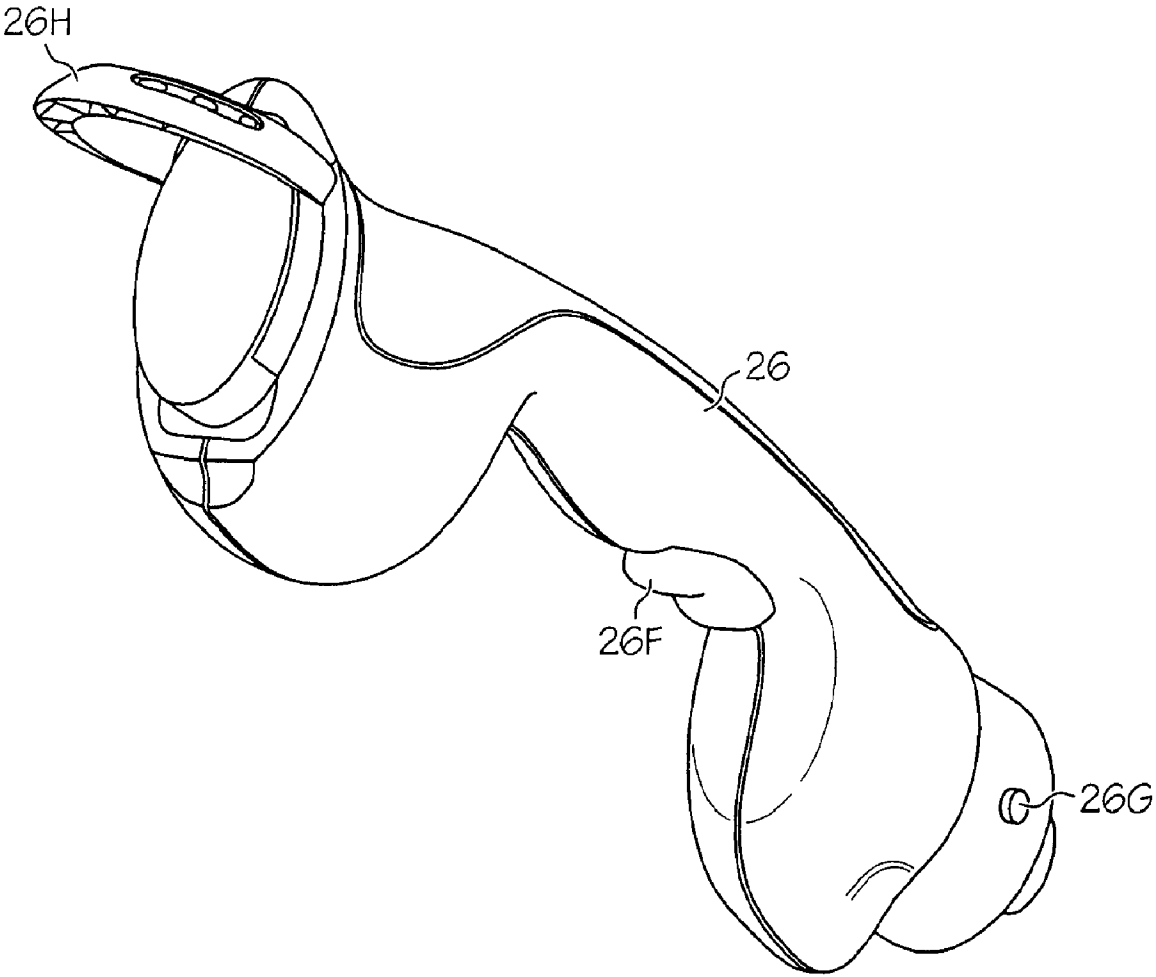
FIG. 17 shows a rear perspective view of the handle of FIG. 16, with a ring with which to hang the handle is deployed.

Additional ergonomic features of the handle are shown in FIGS. 14 through 17. The internal components are placed, along with weights as needed, to effect such a balance. In a preferred embodiment, the handle 26 is weighted with the power supply 12, converter 14, motor 16, drive mechanism 18 (all as shown in FIG. 1) and, optionally, weights (not shown), so that when the handle 26 is attached to the cartridge 20, the center of balance of the spraying device thus formed is preferably located in the grip. Alternatively, the center of balance may move from outside the grip into the grip, or from inside the grip to outside the grip, as the fluid is dispensed. Regardless, as the fluid chamber within the cartridge 20 is emptied, the center of balance shifts slightly along the grip, maintaining ease of operation throughout the life of the cartridge 20. As shown in FIG. 13, the handle 26 may be generally aligned with the cartridge 20, or as shown in FIG. 14, an angle may be formed between the handle 26 and the cartridge 20. This angle may be a rigid connection, or may be formed by an articulable joint (not shown) on the sprayer 10 that enables the angle between the cartridge 20 and the handle 26. The joint may comprise a spring-loaded mechanism, friction lock, or other comparable adjusting mechanism. In addition, in a further optional feature of the device, after connection of the cartridge 20 to the handle 26, the cartridge 20 may further be rotated along its longitudinal axis, preferably to pre-set angles from one to forty five degrees, and more preferably approximately fifteen to thirty degrees, as may be desired by the user, by rotating an interface 23 between the cartridge and handle. The rotation may be provided by a joint (not shown) comprising opposing discs having knobs and detents, spring loaded mechanisms, friction locks, or other comparable adjusting mechanism. Regardless of the configuration used, the desired result is improved manipulative control over the sprayer, more even application, and reduced fatigue for the user.

For best operation, the sprayer 10 should be referenced between the user and the target during EHD spraying. The handle 26 preferably comprises a conductive material suitable for making electrical contact between the sprayer 10 and the user. The material may be, for example, a metal, conductive rubber, plastic, or other polymer. The material for the handle 26 may also comprise a soft-touch material to provide tactile contact between the user and the sprayer 10. As shown in the embodiment illustrated in FIG. 1, the power supply 12 may comprise a power supply pack positioned in the front of the handle 26. In an alternate embodiment, such as that shown in FIGS. 14 through 17, the power supply and associated electronics may be positioned in the rear of handle 26. As discussed above, balance and ergonomic weight distribution is an important consideration for the sprayer 10. In addition to ergonomic considerations, the sprayer 10 may also be designed so that such balance that favors causing the sprayer to strike the ground at the rear (i.e., butt) end of the handle 26 to minimize the potential for damage to the nozzles 22.

Figure 11A:
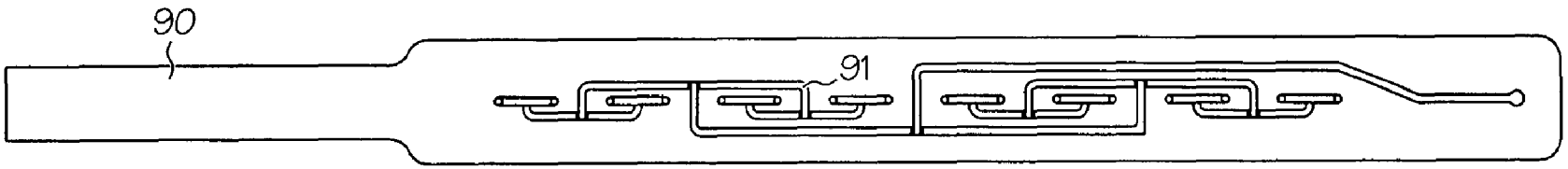
FIGS. 11A and 11B show top and elevation views, respectively, of the manifold.
Figure 11B:
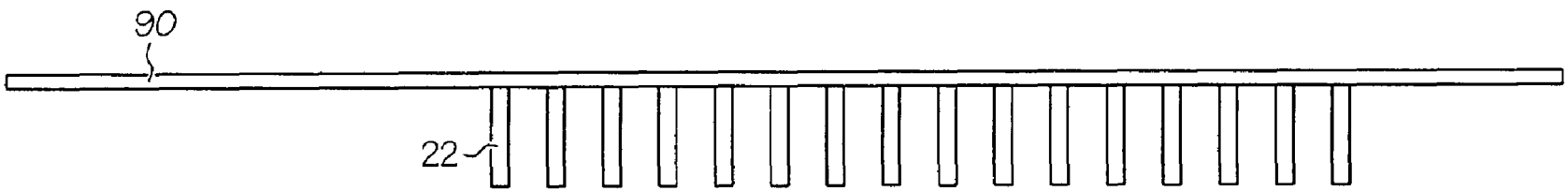

Referring next to FIGS. 11A and 11B in conjunction with FIG. 1, fluid disposed in the fluid chamber of cartridge 20 flows through needle 85 into the manifold 90 which distributes it to the nozzles 22 (shown presently in an alternate, non-tapered construction). In one embodiment, the manifold 90, includes distribution channels 91. The array of nozzles 22 is typically linear, typically between four and seven inches in length, but may be in other forms, such as (but not limited to) circular or otherwise curved. As discussed above, in a preferred embodiment, the manifold 90 and nozzles 22 are preferably made from an electrically conductive plastic. In one form, the material has a surface resistivity between $10^2$ and $10^{14}$ ohms per square, and a volume resistivity of between $10^2$ and $10^{14}$ ohms per centimeter. As mentioned above, suitable base polymer materials may include ABS, HDPE, polypropylene and polycarbonate, all of which can have additives known in the art added to them to make them conductive.

Figure 10:
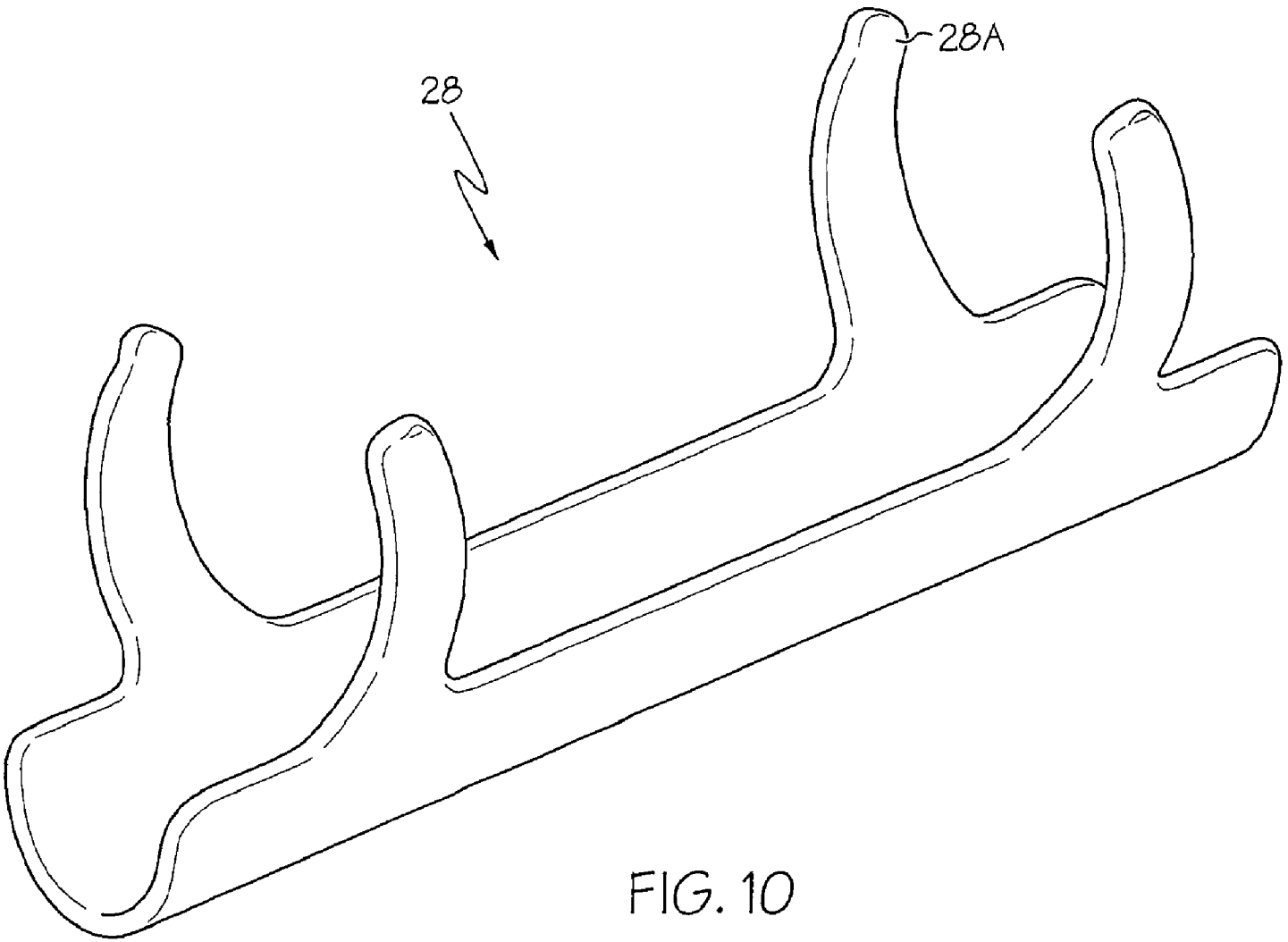
FIG. 10 shows a nozzle cover that can be resiliently snapped onto the cartridge of FIG. 2.

Referring next to FIG. 10, a nozzle cover 28 may also optionally be provided to prevent exposure and possible damage to nozzles 22 when the sprayer 10 is not in use. The cover 28 includes resilient tangs 28A that are designed to clip onto the cartridge 20 to cover and protect the nozzles 22 during storage, advantageously applying slight force generally in the range of 0.5 to 4 pounds, and more preferably 1.5 to 2.5 pounds, across the tips of the nozzles 22. The cover 28 is designed to clip onto the cartridge surface opposite the nozzles during spraying, or can be configured with a hinge element to flip away from the nozzles.

Figure 4:
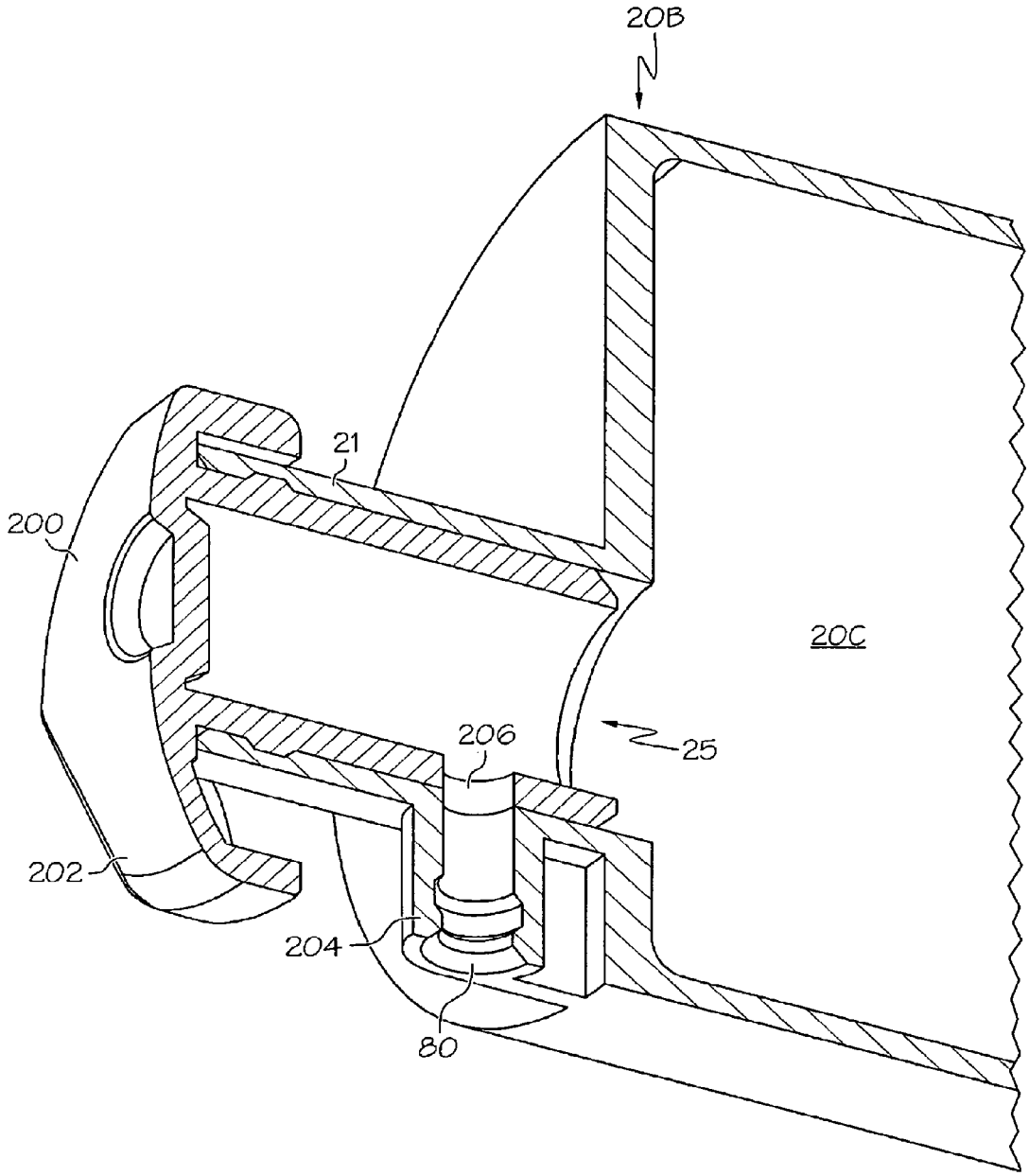
FIG. 4 shows the use of a stop-cock valve as an alternate embodiment for selective closure of the cartridge.

Referring next to FIG. 4, an alternative preferred means for dispensing fluid from the cartridge 20 to the nozzles 22 is shown. A valve device, such as a stop-cock 200, is shown. Unlike the configuration depicted in FIGS. 2 and 3, which included septum 24 being pierced by needle 85 to produce an aperture 25 in the distal end 20B of cartridge 20, the present embodiment utilizes a rotating handle 202 that selectively engages valve 206. The stationary part 204 of stop-cock 200 remains fixed to a complementary neck 21 on cartridge 20 by snap-fit, friction or related connection, and acts as a housing through which discharge tube 80 passes.

While certain representative embodiments and details have been shown for purposes of illustrating the invention, it will be apparent to those skilled in the art that various changes may be made without departing from the scope of the invention, which is defined in the appended claims.

We claim:

1. A spray device comprising:

a handle defining a grip thereon, said handle comprising:

an electric power supply;

a voltage multiplier circuit coupled to said electric power supply;

a motor coupled to said electric power supply and responsive thereto;

a control member configured to electrically connect said electric power supply and said motor; and a driver rotationally coupled to said motor; and a fluid dispensing cartridge supported by said handle through a cantilevered connection therebetween, said cartridge comprising:

a body defining a fluid chamber therein;

a piston disposed in said fluid chamber and responsive to said driver such that rotation of said driver forces movement of said piston to effect dispensing of a fluid disposed in said fluid chamber;

a plurality of nozzles in fluid communication with said fluid chamber such that upon movement of said piston therein, at least a portion of said fluid is discharged from said fluid chamber through said plurality of nozzles in a spray pattern substantially defined by said plurality of nozzles, wherein said nozzles are made from an electrically conductive plastic; and a connection to establish electrical communication between said voltage multiplier circuit and said plurality of nozzles such that upon operation of said spray device, an electric field is set up that is sufficient to comminute said fluid being dispensed from said plurality of nozzles.

2. The spray device of claim 1, wherein said handle comprises a grip at least a portion thereof made from a material selected from the group consisting of metal, electrically conductive plastic, electrically conductive polymer, electrically conductive rubber, and combinations thereof.

3. The spray device of claim 2, wherein said at least a portion of said grip comprises a trigger defining said control member.

4. The spray device of claim 1, wherein a longitudinal dimension of said handle and a longitudinal dimension of said cartridge are substantially aligned along a common longitudinal axis.

5. The spray device of claim 1, wherein said fluid dispensing cartridge further comprises a lead screw disposed in said fluid chamber, said piston being threadedly cooperative with said lead screw.

6. The spray device of claim 5, further comprising a frame configured to provide axial and radial support to said lead screw.

7. The spray device of claim 6, wherein said frame is resiliently connected to said fluid chamber such that same frame inhibits movement of said lead screw along at least one direction of a longitudinal dimension of said cartridge.

8. The spray device of claim 7, wherein said frame comprises a hub-and-spoke construction.

9. The spray device of claim 1, wherein said driver situated in said handle and a proximal end of said lead screw comprise a complementary fit therebetween.

10. The spray device of claim 1, wherein said nozzles are made from a material having a surface resistivity between $10^2$ and $10^{14}$ ohms per square.

* * * * *